US007764234B2

(12) United States Patent
Tsai et al.

(10) Patent No.: US 7,764,234 B2
(45) Date of Patent: Jul. 27, 2010

(54) ANTENNA STRUCTURE

(75) Inventors: Tony Tsai, Taipei (TW); Ryan Chang, Shanghai (CN); Yanping Gao, Shanghai (CN); Jie Zhou, Shanghai (CN)

(73) Assignee: Inventec Appliances Corp., Taipei (TW)

( * ) Notice: Subject to any disclaimer, the term of this patent is extended or adjusted under 35 U.S.C. 154(b) by 417 days.

(21) Appl. No.: 11/819,177

(22) Filed: Jun. 26, 2007

(65) Prior Publication Data

US 2008/0111744 A1 May 15, 2008

(30) Foreign Application Priority Data

Nov. 13, 2006 (TW) ..... 95219974 U

(51) Int. Cl.
*H01Q 9/04* (2006.01)

(52) U.S. Cl. ..... 343/700 MS; 343/702; 343/745; 343/748; 343/828; 343/895

(58) Field of Classification Search ..... 343/700 MS, 343/702, 745, 748, 828, 895
See application file for complete search history.

(56) References Cited

U.S. PATENT DOCUMENTS 6,408,190 B1 * 6/2002 Ying ..... 455/553.1
7,400,300 B2 * 7/2008 Qi et al. ..... 343/700 MS
7,403,164 B2 * 7/2008 Sanz et al. ..... 343/702
7,405,703 B2 * 7/2008 Qi et al. ..... 343/702
7,423,592 B2 * 9/2008 Pros et al. ..... 343/700 MS
7,466,273 B2 * 12/2008 Lee et al. ..... 343/702

* cited by examiner

*Primary Examiner*—Douglas W Owens
*Assistant Examiner*—Chuc D Tran
(74) *Attorney, Agent, or Firm*—Wang Law Firm; Li K. Wang

(57) ABSTRACT

An antenna structure is disposed on a substrate. The antenna structure includes a ⊓-shaped radiation body and a first radiation body, and both share a feeding end and a grounding end. The feeding end and the grounding end are disposed to a side edge of the ⊓-shaped radiation body. The positions of the feeding end and the grounding end allow the ⊓-shaped radiation body to form the operation of two frequency bands. Moreover, the first radiation body is vertically extended from the side edge near the feeding end disposed to the ⊓-shaped radiation body, and continuously extended from an end to keep a spacing between periphery of the ⊓-shaped radiation body and the first radiation body, and extended to a front of an opening of the ⊓-shaped radiation body, thereby vertically extending toward the opening. Therefore, the first radiation body could provide the operation of another frequency band.

11 Claims, 6 Drawing Sheets

ANTENNA STRUCTURE

FIELD OF THE INVENTION

The present invention generally relates to an antenna structure, and more specifically relates to the antenna design that combines CDMA (Code Division Multiple Access) with GPS (Global Positioning System).

BACKGROUND OF THE INVENTION

The convenience of wireless communication brings the development of wireless industry. Since a mobile phone is presented to public, it almost becomes the necessary of our life. Antennas installed in the mobile phones may play a role that transmits and receives wireless signals in wireless communication.

To increase competition ability, the functions of the mobile phone are continuously increased. It does not only provide a main antenna for communication, but also needs to add one or more antennas for other wireless applications. Consequently, it will occupy more PCB (printed circuit board) areas to achieve better performance while disposing these antennas in limited spaces. As lots and lots of communication products tend to become the miniaturization, the volume of embedded antennas is also shrunk to meet the miniaturization requirement. It is an important issue of enhancing the functions of the antennas in the limited PCB spaces.

Referring to FIG. 1 for the schematic diagram illustrates a conventional CDMA antenna structure. The CDMA antenna structure 1 includes at least two radiation bodies 11, 12, a grounding end 13 and its extending body 15, a feeding end 14 and its extending body 16 and at least one through hole 17. The radiation bodies 11, 12 share the feeding end 14 and the grounding end 13, and the radiation bodies 11, 12 have different lengths for receiving and transmitting CDMA wireless signals of different frequency bands. The longer radiation body 12 is used to receive and transmit wireless signals of low frequency, and the shorter radiation body 11 is used to receive and transmit wireless signals of high frequency, and the through hole 17 is used for fastening purpose.

Referring to FIG. 2 for the schematic diagram illustrates a conventional GPS antenna structure. The GPS antenna structure 2 includes a radiation body 21, a grounding end 22 and its extending body 24, a feeding end 23 and its extending body 25 and at least one through hole 26. The through hole 26 is used for fastening purpose, and the GPS antenna structure is provided for receiving and transmitting wireless signals of GPS frequency bands.

However, if a user would like to dispose the two aforementioned antenna structures (as flat plate antennas) on the substrate, it will waste cost and space while installing these antennas. To overcome the foregoing shortcomings, the inventor(s) of the present invention based on years of experience in the related field to conduct extensive researches and experiments, and finally invented an antenna structure, as a method or a basis for resolving the foregoing drawbacks.

SUMMARY OF THE INVENTION

One primary aspect of the present invention is to provide an antenna structure, and more particularly to an antenna design that combines CDMA with GPS.

To achieve the foregoing aspect, the antenna structure of the invention may be disposed on a substrate, and includes at least a U-shaped radiation body, a feeding end, a grounding end and a first radiation body, wherein the feeding end and the grounding end are disposed to a side edge of the U-shaped radiation body to enable the U-shaped radiation body to form the operation of two frequency bands. Moreover, the first radiation body is vertically extended from the side edge near the feeding end disposed to the U-shaped radiation body, and continuously extended from a last end to keep a spacing between the U-shaped radiation body and the first radiation body, and extended to a front of an opening of the U-shaped radiation body, thereby vertically extending toward the opening.

The U-shaped radiation body is suitable for the operations of low frequency band, such as CDMA800 MHz, and high frequency band, such as CDMA1900 MHz. The first radiation body is suitable for the operations of frequency band of GPS1575 MHz. The surfaces of the radiation body and the extending body can be plated with different metal materials to satisfy the requirement of signal transmission, wherein the surface of the radiation body can be plated with nickel and the extending body can be plated with gold. Therefore, the invention improves the flexibility of disposing the antenna, and saves printed circuit board space of handheld equipment, and has advantages of simple installation and better performance.

To make it easier for our examiner to understand the object of the invention, its innovative features and performance, a detailed description and technical characteristics of the present invention are described together with the drawings as follows.

DETAILED DESCRIPTION OF THE PREFERRED EMBODIMENTS

Figure 1:
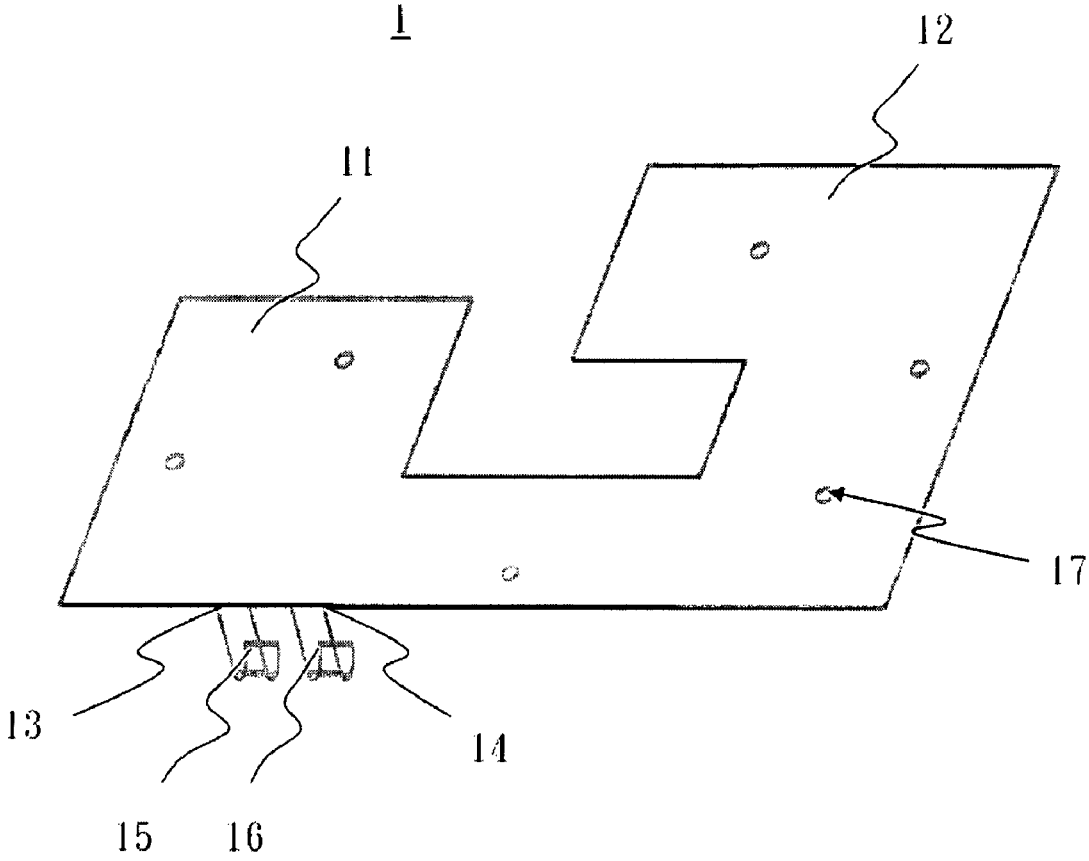
FIG. 1 is a schematic diagram illustrating a conventional CDMA antenna structure.
Figure 2:
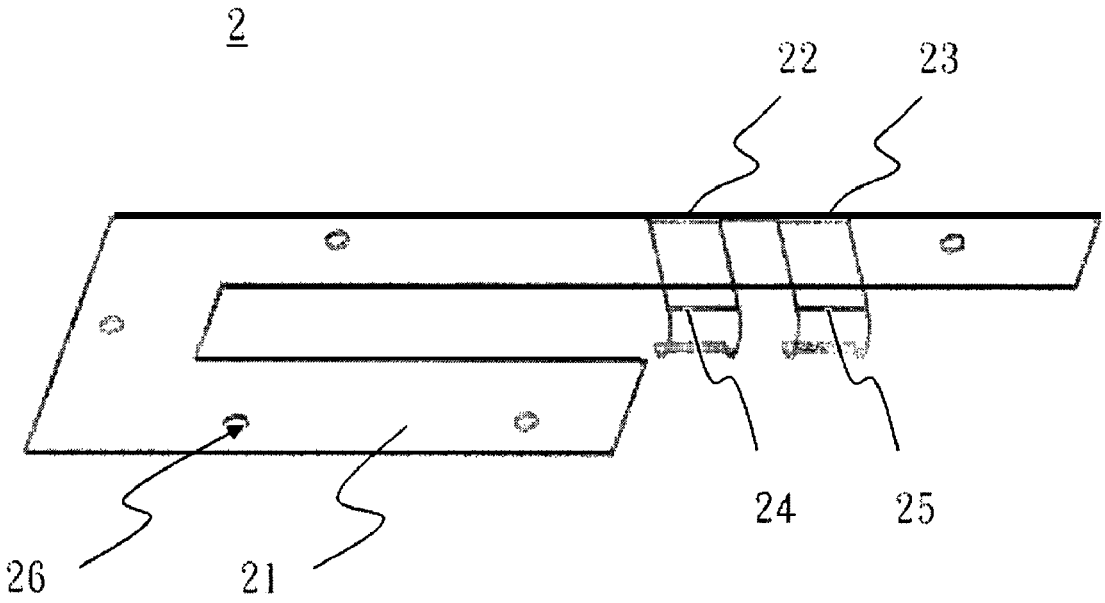
FIG. 2 is a schematic diagram illustrating a conventional GPS antenna structure.
Figure 3:
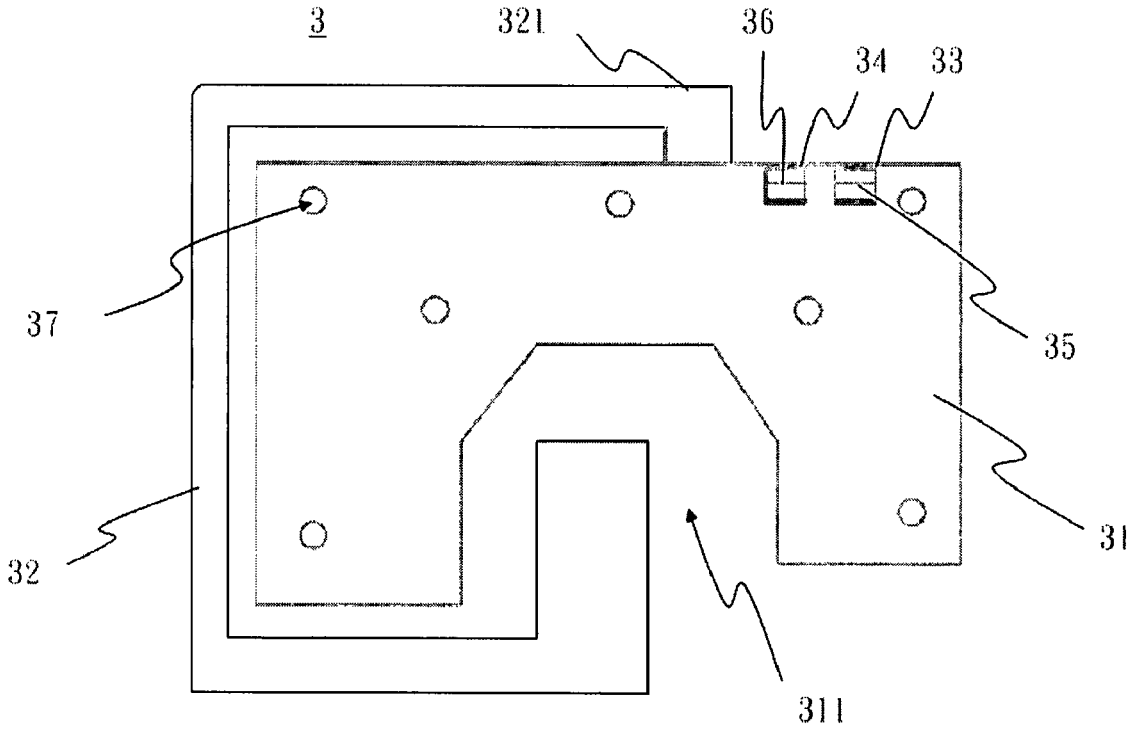
FIG. 3 is a schematic diagram illustrating an antenna structure of one embodiment of the invention.

Referring to the related figures for the antenna structure according to one embodiment of the present invention, wherein the same elements are described by the same reference numerals. Referring to FIG. 3 for the schematic diagram of an antenna structure of one embodiment of the invention is illustrated. The antenna structure 3 includes at least a U-shaped radiation body 31, a first radiation body 32, a feeding end 34 and a grounding end 33, wherein the feeding end 34 and the grounding end 33 are disposed to a side edge of the U-shaped radiation body 31, and positions of the feeding end 34 and the grounding end 33 enable the U-shaped radiation body 31 to form the operation of two different bands. Simultaneously, the first radiation body 32 is vertically extended from the side edge near the feeding end 34 disposed to the U-shaped radiation body 31, and continuously extended from an end 321 to keep a spacing between periphery of the U-shaped radiation body 31 and the first radiation body 32, and extended to a front of an opening 311 of the U-shaped radiation body 31, thereby vertically extending toward the opening 311. Moreover, the feeding end 34 and the grounding end 33 form extending bodies 36 and 35 respectively, and the U-shaped radiation body 31 further has a plurality of holes 37 for fastening the antenna structure 3.

Figure 4:
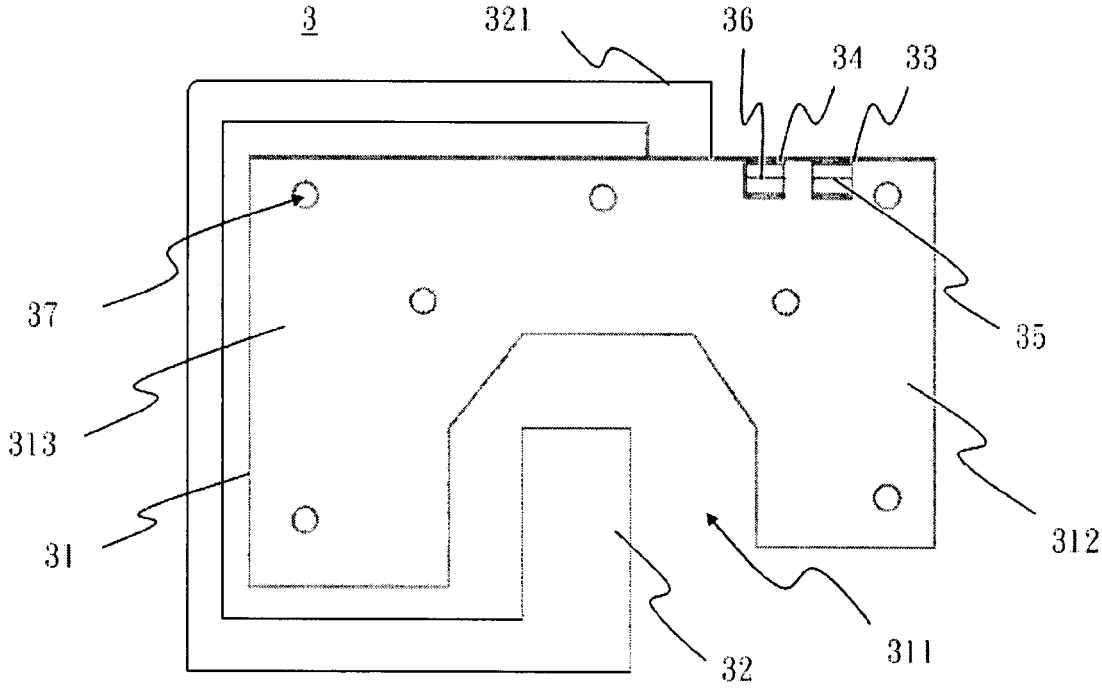
FIG. 4 is a schematic diagram illustrating an antenna structure of one embodiment of the invention.

Referring to FIG. 4 for the schematic diagram illustrates an antenna structure of one embodiment of the invention. The antenna structure 3 shown in FIG. 4 is a whole structure according to FIG. 3, wherein the U-shaped radiation body 31 is divided into a radiation body 312 for a first band and a radiation body 313 for a second band. The radiation body 312 of the U-shaped radiation body 31 for the first band is operated with a high frequency band such as CDMA 1900 MHz, and the length of the radiation body 312 is shorter than the radiation body 313 operated with a low frequency band, such as CDMA800 MHz. The frequency band of the first radiation body 32 is generally GPS1575 MHz, and shares the feeding end 34 and the grounding end 33 disposed on the U-shaped radiation body 31. Last ends of the extending bodies 35 and 36 are extended to a side of the U-shaped radiation body 31. In addition, the plurality of holes 37 may help the antenna structure 3 to be fastened to fixed points of a substrate (such as a circuit board). The U-shaped radiation body 31 is preferably a flat plate, and surfaces of the radiation bodies 31, 32 and the extending bodies 35, 36 are plated with different metal materials to satisfy the requirement of signal transmission, wherein the radiation bodies 31, 32 can be a metal material and the surfaces of the radiation bodies 31, 32 can be plated with nickel, and the last ends of the extending bodies 35, 36 are in arc shaped and their surfaces can be plated with gold. The first radiation body 32 can be a metal material, and the surface of the first radiation body 32 can be plated with nickel.

Figure 5:
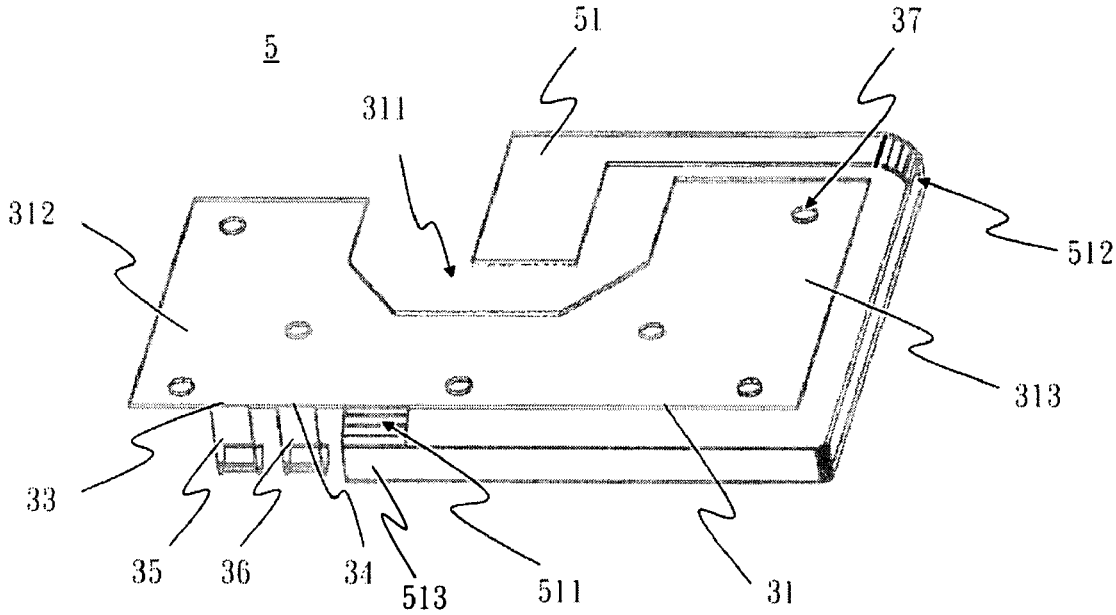
FIG. 5 is a tridimensional diagram illustrating another antenna structure of one embodiment of the invention.
Figure 6:
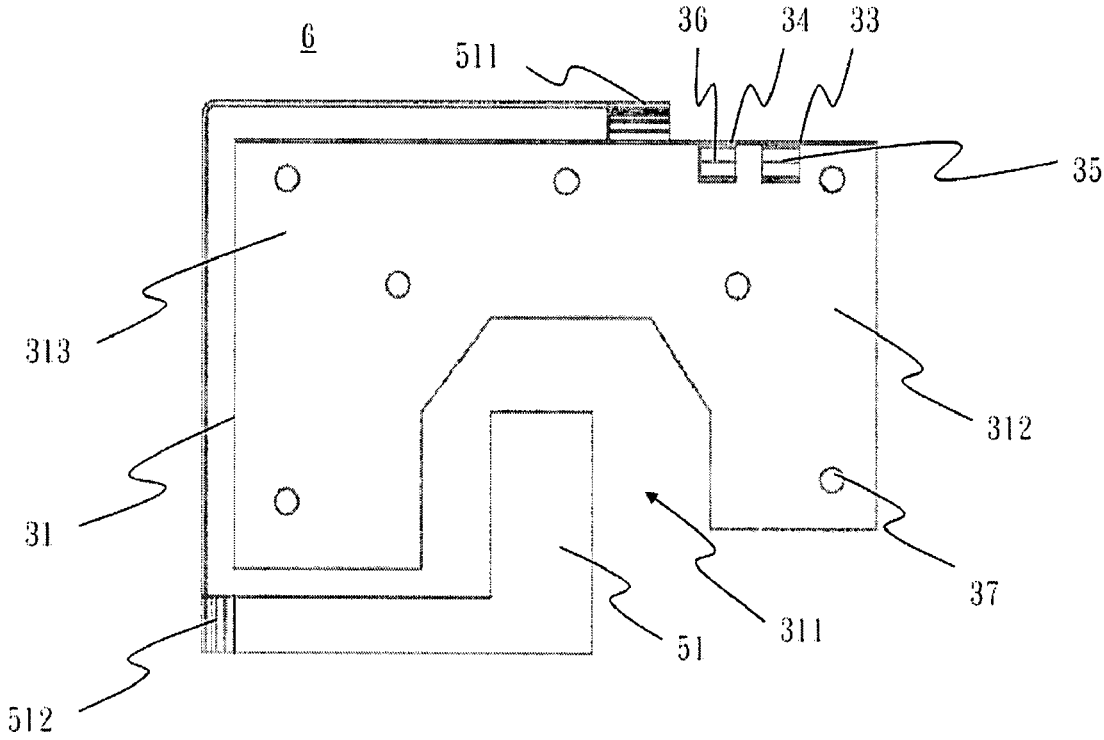
FIG. 6 is a top view illustrating another antenna structure of one embodiment of the invention.

Referring to FIGS. 5 and 6, FIG. 5 is a tridimensional drawing of another antenna structure of another embodiment of the invention, and FIG. 6 is a top view of another antenna structure according to FIG. 5 of another embodiment of the invention. The antenna structure 5 includes a U-shaped radiation body 31, a feeding end 34, a grounding end 33 and a first radiation body 51, wherein the feeding end 34 and grounding end 33 are disposed to the side edge of the U-shaped radiation body 31 so that the U-shaped radiation body 31 can form the operation of two frequency bands. The first radiation body 51 is downwardly extended from the side edge near the feeding end 34 disposed to the U-shaped radiation body 31 according to a curved surface 511 to enable an end 513 to be vertical the U-shaped radiation body 31, and continuously extended from the end 513 to keep a spacing between periphery of the U-shaped radiation body 31 and the first radiation body 51. The first radiation body 51 near the opening 311 then is upwardly extended according to a curved surface 512, and at the same plane together with the U-shaped radiation body 31, and continuously extended to a front of the opening 311, thereby vertically extending toward the opening 311. The shaped variation is suitable for various functions, and further provides better quality of transmitting and receiving quality.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An antenna comprising:

a radiation body having a side edge and an opening opposing the side edge;

a feeding end disposed to the side edge of the radiation body;

a grounding end disposed to the side edge of the radiation body adjacent the feeding end; and a first radiation body vertically extending away from the side edge near the feeding end of the radiation body, and continuously extending along the radiation body and keeping a space away from the radiation body, and extending into the opening of the radiation body, wherein the feeding end and the grounding end enable the radiation body to operate in two frequency bands.

2. The antenna of claim 1, wherein the first radiation body extending downwardly from the side edge near the feeding end according to a first curved surface to enable an end to be vertical to the radiation body, and continuously extending from the end along the radiation body and keeping a space away from the radiation body; and the first radiation body near the opening extending upwardly according to a second curved surface and onto a same plane together with the radiation body, and continuously extending into the opening.

3. The antenna of claim 1, wherein the antenna is further disposed on a substrate.

4. The antenna of claim 3, wherein the substrate is a circuit board.

5. The antenna of claim 1, wherein the radiation body is a flat plate.

6. The antenna of claim 1, wherein the radiation body operates with CDMA frequency bands.

7. The antenna of claim 1, wherein the first radiation body operates with GPS frequency bands.

8. The antenna of claim 1, wherein the radiation body is made from metal, and a surface of the radiation body is plated with nickel.

9. The antenna of claim 1, wherein the first radiation body is made from metal, and a surface of the first radiation body is plated with nickel.

10. The antenna of claim 1, wherein the feeding end and the grounding end each having an extending body with an arc shape last end extending downwardly from the radiation body.

11. The antenna of claim 10, wherein a surface of the extending body is plated with gold.

* * * * *